US011992073B2

(12) United States Patent
Perera et al.

(10) Patent No.: US 11,992,073 B2
(45) **Date of Patent: *May 28, 2024**

(54) LIGHTWEIGHT, PERMEABLE GARMENT FORMED FROM MONOFILAMENT YARNS

(71) Applicant: NIKE, Inc., Beaverton, OR (US)

(72) Inventors: Tharindu Sashane Perera, Nugegoda (LK); S. B. Kith Vishwa Udula Bandara, Nugegoda (LK); Niroshan Madusanka Palliyaguruge, Nugegoda (LK)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/103,094

(22) Filed: Jan. 30, 2023

(65) Prior Publication Data

US 2023/0165331 A1 Jun. 1, 2023

Related U.S. Application Data

(63) Continuation of application No. 16/358,127, filed on Mar. 19, 2019, now Pat. No. 11,564,430.

(Continued)

(51) Int. Cl.
*A41D 31/14* (2019.01)
*A41B 1/08* (2006.01)

(Continued)

(52) U.S. Cl.
CPC ..... *A41D 31/14* (2019.02); *D04B 1/246* (2013.01); *D04B 21/207* (2013.01); *A41B 1/08* (2013.01);

(Continued)

(58) Field of Classification Search
CPC ..... A41D 31/14; A41D 2500/10; A41D 2500/50; A41D 1/04; D04B 1/246;

(Continued)

(56) References Cited

U.S. PATENT DOCUMENTS 3,842,438 A 10/1974 Campbell et al.
4,107,371 A 8/1978 Dean (Continued)

FOREIGN PATENT DOCUMENTS

CN 201321530 Y 10/2009
CN 102134776 A 7/2011

(Continued)

OTHER PUBLICATIONS

Super-high-density Polyester/Nylon Composite Fabric, Fibers & Textiles, Toray Industries, Inc., Available online at: <https://web.archive.org/web/20150327032334/http:/www_toray_us/products/lexliles/lex_012.html>, Mar. 27, 2015, 2 pages.

*Primary Examiner* — Elizabeth M Imani
(74) *Attorney, Agent, or Firm* — Shook, Hardy & Bacon L.L.P.

(57) ABSTRACT

Aspects herein relate to a garment that comprises a first knit textile comprising a cell configuration having a knitted perimeter portion and a knitted central portion that is integrally knitted with and enclosed within the knitted perimeter portion. The knitted perimeter portion comprises a first percentage by weight of a first yarn type and a second yarn type. The knitted central portion comprises only the second yarn type. The knitted textile further comprises a second knit textile that is integrally knit with the first knit textile and comprises a plurality of linear knit portions. A first linear knit portion comprises a first percentage by weight of the first yarn type and a second linear knit portion comprises solely the second yarn type. The first linear knit portion of the plurality of linear portions is directly interlooped with a second leaner knit portion.

17 Claims, 5 Drawing Sheets

Related U.S. Application Data

(60) Provisional application No. 62/678,019, filed on May 30, 2018.

(51) Int. Cl.
*D04B 1/24* (2006.01)
*D04B 21/20* (2006.01)

(52) U.S. Cl.
CPC ..... *A41B 2400/20* (2013.01); *A41B 2500/10* (2013.01); *A41B 2500/50* (2013.01); *A41D 2500/10* (2013.01); *A41D 2500/50* (2013.01); *D10B 2331/02* (2013.01); *D10B 2331/042* (2013.01); *D10B 2501/04* (2013.01)

(58) Field of Classification Search
CPC ..... D04B 21/207; D04B 1/16; D04B 1/121; D10B 2331/042; D10B 2331/02; D10B 2501/04; D10B 2401/02; D10B 2331/04; D10B 2401/021; D10B 2401/022; D10B 2401/10; D10B 2403/02; A41B 2500/10; A41B 2500/50; A41B 1/08; A41B 2400/20; A41B 9/06
See application file for complete search history.

(56) References Cited

U.S. PATENT DOCUMENTS

| | | | |
|---|---|---|---|
| 4,141,388 | A | 2/1979 | Romanski et al. |
| 4,403,632 | A | 9/1983 | Romanski et al. |
| 5,290,269 | A | 3/1994 | Heiman |
| 5,906,876 | A | 5/1999 | Conway |
| 6,763,855 | B2 | 7/2004 | Rougvie |
| 7,024,891 | B2 | 4/2006 | Huang et al. |
| 7,043,766 | B1 | 5/2006 | Foreman et al. |
| 7,632,765 | B2 | 12/2009 | Shalaby et al. |
| 7,707,857 | B1 | 5/2010 | McMurray et al. |
| 7,842,628 | B2 | 11/2010 | Yasui et al. |
| 8,283,267 | B2 | 10/2012 | Leonard et al. |
| 9,121,542 | B2 | 9/2015 | Odaka et al. |
| 9,636,637 | B2 | 5/2017 | Earhart et al. |
| 2003/0186610 | A1 | 10/2003 | Peters et al. |
| 2004/0171324 | A1 | 9/2004 | Miller et al. |
| 2006/0223400 | A1 | 10/2006 | Yasui et al. |
| 2008/0082035 | A1 | 4/2008 | Evans |
| 2008/0096001 | A1 | 4/2008 | Emden et al. |
| 2012/0132309 | A1 | 5/2012 | Morris |
| 2013/0037248 | A1 | 2/2013 | Ackroyd et al. |
| 2014/0366346 | A1 | 12/2014 | Lee et al. |
| 2016/0362831 | A1 | 12/2016 | Minor |
| 2017/0172216 | A1 | 6/2017 | Casali |
| 2017/0340027 | A1 | 11/2017 | Montoya et al. |
| 2018/0055117 | A1 | 3/2018 | Bailey et al. |
| 2019/0365001 | A1 | 12/2019 | Perera et al. |

FOREIGN PATENT DOCUMENTS

| | | | |
|---|---|---|---|
| CN | 202168725 | U | 3/2012 |
| CN | 102277749 | B | 8/2013 |
| DE | 20207797 | U1 | 9/2002 |
| EP | 1936015 | A2 | 6/2008 |
| GB | 521958 | A | 6/1940 |
| GB | 533105 | A | 2/1941 |
| JP | 2005-163225 | A | 6/2005 |
| KR | 10-2016-0139506 | | 12/2016 |
| WO | 2011/096131 | A1 | 8/2011 |

LIGHTWEIGHT, PERMEABLE GARMENT FORMED FROM MONOFILAMENT YARNS

CROSS-REFERENCE TO RELATED APPLICATIONS

This application is a continuation of U.S. application Ser. No. 16/358,127 (filed Mar. 19, 2019, and issuing as U.S. Pat. No. 11,564,430), which claims priority to, and the benefit of, U.S. Provisional Patent Application No. 62/678,019 (filed May 30, 2018). The entirety of each of the aforementioned applications is incorporated herein by reference in its entirety.

TECHNICAL FIELD

Aspects herein relate to an integrally knit garment having portions formed using monofilament yarns, where the garment is lightweight and exhibits a high degree of air permeability.

BACKGROUND

Traditionally, garments that exhibit higher air permeability in certain areas of the garment rely on a panel-type construction where mesh inserts are placed where increased permeability is needed.

DESCRIPTION OF THE DRAWINGS

Illustrative aspects of the present invention are described in detail below with reference to the attached drawing figures, which are incorporated by reference herein and wherein.

DETAILED DESCRIPTION

Figure 1A:
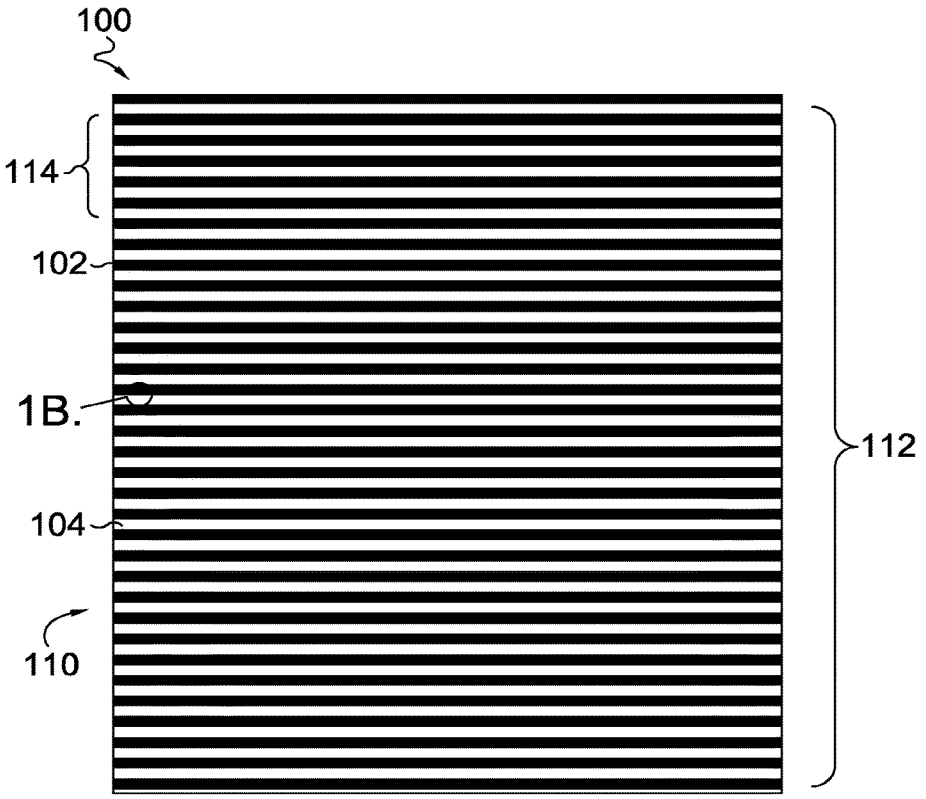
FIG. 1A depicts a knit textile comprising a linear knit structure in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to an integrally knit textile and garments formed from the integrally knit textile. In aspects, the textiles and garments described herein are lightweight, exhibit moisture-management characteristics, and further exhibit a high degree of air permeability due to the yarn types and knit construction used to form the textile. In aspects, the textile is formed using a first yarn type and a second yarn type. The first yarn type comprises a terephthalate polymer. More specifically, the first yarn type comprises polyethylene terephthalate (PET), commonly known as polyester. And the second yarn type comprises a monofilament polyamide, commonly known as nylon. Use of monofilament polyamide yarns as opposed to, for instance, monofilament PET yarns contributes to a better hand feel for the textile. As well, monofilament polyamide yarns are generally stronger and more resistant to abrasion than, for example, PET yarns and are also more translucent/transparent than other yarn types. Use of monofilament polyamide yarns contributes to the textile being lightweight and also contributes to the enhanced air permeability characteristics of the textile. As well, use of monofilament polyamide yarns helps to reduce snagging as compared to, for instance, the use of multifilament polyamide yarns. Use of PET yarns contributes to the moisture-management characteristics of the textile as PET yarns generally have a lower moisture regain as compared to polyamide yarns (about 0.4% compared to about 8%). Because the PET yarns have a low moisture regain, they promote moisture wicking (by, for instance, capillary action) between the PET filaments instead of absorbing the moisture thereby helping to move moisture away from, for example, a skin surface of a wearer.

As mentioned above, the knit construction of the textile is also important for achieving the high degree of air permeability and moisture-management characteristics of the textile. In aspects, the knit construction comprises at least a first portion comprising a first percentage by weight of the first yarn type (e.g., PET yarns) and the second yarn type (e.g., monofilament polyamide yarns). The knit construction further comprises a second portion that is integrally knitted from the first portion. The second portion comprises the second yarn type and a second percentage by weight of the first yarn type, where the second percentage by weight of the first yarn type is less than the first percentage by weight of the first yarn type. One result of this knit construction is that the second portions are primarily formed from the monofilament polyamide yarns, which contributes to the high air permeability of the textile. As well, because the monofilament polyamide yarns are generally transparent/translucent, the second portions are generally transparent/translucent which provides an interesting visual aesthetic to the textile. Because the first portions comprise a greater percentage by weight of the PET yarns, the first portions may facilitate the wicking of moisture away from, for instance, the body surface of a wearer.

Continuing with respect to the knit construction of the textile and garments made therefrom, it is contemplated herein that the garment may be circular knitted (or flat knitted) to minimize or eliminate the number of seams used to form the garment. During the knitting process, the placement of the first and second portions on the resulting garment may be engineered to achieve functional benefits. For instance, the first portions in combination with the second portions may be positioned on the garment to correspond to high heat and high sweat-producing areas of the wearer. Because the first portions contribute to the moisture-management characteristics of the garment, and because the second portions contribute to the high levels of air permeability of the garment, positioning the first and second portions as described helps to cool the wearer and further helps to move moisture away from the skin surface of the wearer. In another example, the garment may be engineered to comprise one or more areas formed using the first portions without the second portions. Because the first portions are less transparent/translucent than the second portions, the first portions may be positioned on the garment to correspond to areas of the wearer needing increased modesty.

Accordingly, aspects of the present invention relate to a textile comprising at least a first surface and a second surface opposite the first surface. The first surface of the textile comprises a plurality of cells, each cell comprising a perimeter comprising a first percentage by weight of a first yarn type and a second yarn type. The plurality of cells further comprises a central region enclosed within the perimeter, the central region comprising the second yarn type and a second percentage by weight of the first yarn type, wherein the second percentage by weight of the first yarn type is less than the first percentage by weight of the first yarn type. Further, a first cell and a second cell in the plurality of cells have at least one common portion of the perimeter.

Aspects herein are additionally directed to a textile having a first surface and a second surface opposite the first surface. The first surface of the textile comprises a first portion comprising a first percentage by weight of a first yarn type and a second yarn type. The first surface further comprises a second portion comprising the second yarn type and a second percentage by weight of the first yarn type, wherein the second percentage by weight of the first yarn type is less than the first percentage by weight of the first yarn type, and wherein the first portion and the second portion integrally extend from one another.

Aspects herein are further directed to an apparel item comprising a knit textile having a first surface and a second surface opposite the first surface, the first surface of the knit textile comprising at least a first portion knitted using a second yarn type and a first percentage by weight of a first yarn type and a second portion knitted using the second yarn type and a second percentage by weight of the first yarn type. The second percentage by weight of the first yarn type in the second portion is less than the first percentage by weight of the first yarn type in the first portion. Additionally, the first portion and the second portion of the apparel item are integrally knit from one another.

Positional terms as used herein to describe a garment such as "anterior," "posterior," "front," "back," "upper," "lower," "inner-facing surface," "outer-facing surface," and the like are with respect to the garment being worn as intended and as shown and described herein by a wearer standing in an upright position.

Continuing, the term "terephthalate polymer" when describing, for example, a yarn means a yarn having filaments or fibers formed from terephthalate polymers and includes, for example, polyethylene terephthalate (PET). PET is a common thermoplastic polymer resin of the polyester family. In the context of textiles, PET is generally referred to by its common name, polyester. Additionally, "cationic dyeable PET" is a special fiber that has undergone a change during polymerization to increase its affinity to certain dyes.

The term "polyamide" when describing yarns means a yarn having filaments or fibers formed from any long-chain synthetic polyamide. In the context of textiles, synthetic polyamides are commonly referred to as nylon.

The term "continuous" as used herein means a textile having a continuous knit face without integrally formed or engineered openings. Examples would include a single jersey knit construction, a half tricot knit construction, a double jersey knit construction, and the like.

The term "multifilament yarn" as used herein means a yarn having two or more filaments within a single yarn strand while the term "monofilament" as used herein means a yarn formed from a single filament.

As well, the term "integral" as used herein means a textile having at least one textile element (e.g., yarn, thread, or filament) that extends between different areas of a textile. For instance, with respect to the textile and garments described herein, the term integrally knit may mean the textile or garment has a continuous yarn that extends through different areas of the garment. To describe this with respect to a knit construction, the term "integrally knit" may mean a textile or garment having a yarn from one or more knit courses being interlooped with one or more knit courses of another area in a portion of the garment. To describe this with respect to the first and second portions detailed above, the term "integrally knit" may mean that a yarn (e.g., a polyamide yarn) extends from the first portion into the second portion. Additionally, the knit textile as described herein may mean that the textile has different areas or portions exhibiting different properties based on the yarn type found in each area and the varying percentage by weight of the yarn type in that area. This may be opposed to a panel type construction where two or more separate materials are joined by affixing edges or surfaces by, for example, stitching, bonding, adhesives, and the like, such that there is no continuity of a yarn or textile element between the two materials.

The term "percentage by weight" of a yarn type as used herein is with respect to an area of a predetermined size. Further, when comparing the percentage by weight of a particular yarn type in two different areas, it is assumed that the two areas have the same predetermined size. Using an example, area A of a textile may comprise 50% by weight of a first yarn type and 50% by weight of a second yarn type, and area B of the textile, which is the same size as area A, may comprise 100% by weight of the first yarn type and 0% by weight of the second yarn type.

Finally, as used herein, the term "moisture regain" is the percentage of moisture a bone-dry fiber or filament will absorb from the air when at standard temperature and relative humidity.

Figure 1B:
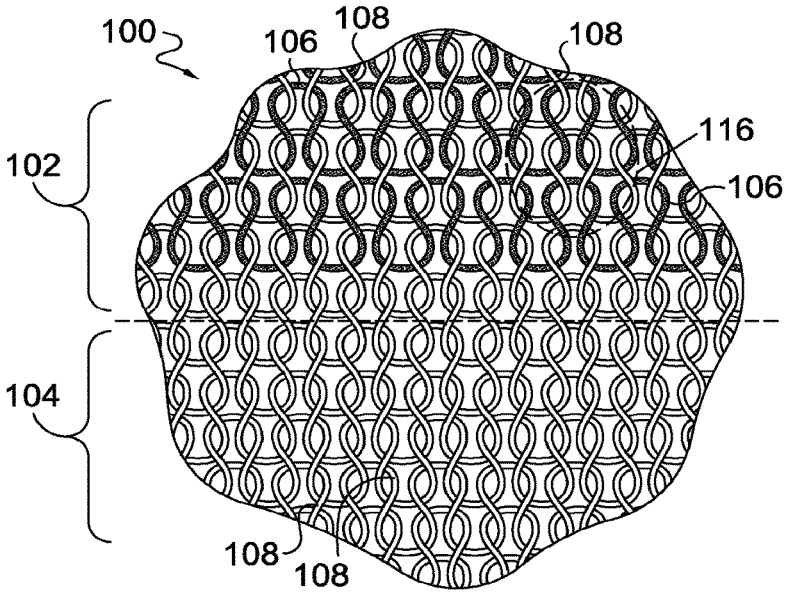
FIG. 1B depicts a close-up view of a portion of the knit textile depicted in FIG. 1A, in accordance with aspects herein.

Turning now to FIGS. 1A and 1B, a knit textile 100 comprising a linear integrally knit structure 114 and the close-up of the knit textile 100 respectively are illustrated in accordance with aspects herein. The knit textile 100 comprises a first surface 110 and second surface (not shown) opposite the first surface. At least the first surface 110 of the knit textile 100 comprises a plurality of first portions 102 and a plurality of second portions 104. It is also contemplated herein that the second surface may comprise the same plurality of first portions 102 and the same plurality of second portions 104. Or, in aspects, the second surface may comprise a different knit construction than the first surface 110. Any and all aspects, and any variation thereof, are contemplated as being within aspects herein. The knit textile 100 comprises an integrally knit construction 116, best seen in FIG. 1B, formed from a first yarn type 106 (shown with stippling) and a second yarn type 108 (shown without stippling). The integrally knit construction 116 in combination with the first yarn type 106 and second yarn type 108 may impart different properties to the knit textile 100 and more specifically, to each of the plurality of first portions 102 or plurality of second portions 104 in the knit textile 100 as described below.

As seen in FIG. 1A, each of the plurality of second portions 104 are spaced apart from an adjacent second portion 104 by at least one first portion 102. To describe it differently, FIG. 1A depicts each first portion 102 spaced apart by one second portion 104 in a repeating pattern 112 in the knit textile 100. While FIG. 1A depicts each second portion 104 having generally the same width and each first portion 102 having generally the same width, the width of each second portion 104 and each first portion 102 may vary such that a particular first portion 102 may be wider than another first portion 102 and a particular second portion 104 may be wider than another second portion 104. Moreover, it is contemplated herein that although FIG. 1A depicts the width of each first portion 102 being generally the same as the width of each second portion 104, the width of the first portions 102 may be greater than or less than the width of the first portions 102. Any and all aspects, and any variation thereof, are contemplated as being within aspects herein.

As best seen in FIG. 1B, the first portion 102 comprises both the first yarn type 106 and the second yarn type 108 knit in, for instance, a single jersey knit construction although other knit constructions are contemplated herein. The first portion 102 comprises a first percentage by weight of the first yarn type 106, which is greater than 0% but less than 100%. For example, the first portion 102 may comprise from about 30% by weight to about 90% by weight of the first yarn type 106, from about 50% by weight to about 80% by weight, or from about 50% by weight to about 70% by weight of the first yarn type 106. The term "about" as used herein means within ±10% of a designated value. The first portion 102 also comprises the second yarn type 108, where the first yarn type 106 is integrally knit with the second yarn type 108.

In aspects, and as shown in FIG. 1B, the second portion 104 comprises, for instance, 0% by weight of the first yarn type 106. In other words, it is contemplated herein that the first yarn type 106 does not extend into the second portion 104 such that the second portion 104 comprises 100% by weight of the second yarn type 108. However, other aspects herein contemplate that the first yarn type 106 may extend into the second portion 104 such that the second portion comprises a second percentage by weight of the first yarn type 106, and where the second percentage by weight of the first yarn type 106 is less than the first percentage by weight of the first yarn type 106 in the first portion 102. For example, the percentage by weight of the first yarn type 106 in the second portion may be from about 20% by weight to about 80% by weight, from about 40% by weight to about 70% by weight or from about 40% by weight to about 60% by weight. In other words, when comparing equal size areas in the first portion 102 and the second portion 104, the first portion 102 comprises a greater percentage by weight of the first yarn type 106 than the second portion 104.

The knit construction depicted in FIGS. 1A and 1B comprises a knit textile 100 in which the first yarn type 106 and second yarn type 108 are knit to form the linear integrally knit structure 114 as seen in FIG. 1A. In other aspects, the knit textile 100 formed from the first yarn type 106 and second yarn type 108 may be knit to form other repeating patterns such as an ovoid structure (e.g. FIGS. 2A and 2B). In yet other aspects, the knit textile 100 formed from the first yarn type 106 and second yarn type 108 may be knit to form other shaped structures where the shaped structures may vary in size.

As described, the knit textile 100 in accordance with aspects herein is formed from two yarn types. The particular properties of each type of yarn, along with the knitted structures (e.g., first portions 102 and second portions 104) may provide the knit textile 100 with different properties. The first yarn type 106, may, for example, include a terephthalate polymer such as polyethylene terephthalate (PET) (e.g. polyester). Additionally, the PET may further include a cationic dyeable PET. In an aspect, the first yarn type 106 has a denier from about 30 denier to about 100 denier. The second yarn type 108, may, for example, include a polyamide such as a monofilament polyamide yarn and is present in both the first portion 102 and the second portions 104. The second yarn type 108 comprising the monofilament polyamide yarn has a denier (D=grams/9000 meters) from about 23 denier to about 43 denier, from about 26 denier to about 39 denier, from about 30 denier to about 25 denier, or about 33 denier. Use of fine denier monofilament polyamide yarns as described herein contributes to the knit textile 100 having a good hand.

In aspects, the PET yarns comprising the first yarn type 106 found in the first portions 102 generally provide better moisture wicking than the monofilament polyamide yarns comprising the second yarn type 108 because they have a lower moisture regain (moisture regain percentage of about 0.4%). Further, as depicted in FIG. 1A, the first portions 102 comprising the first yarn type 106 provide a more opaque presentation than the second portions 104 comprising the second yarn type 108. This is because PET yarns are generally more opaque than monofilament polyamide yarns. This opaque presentation provides for more modesty in the first portions 102 where both the first yarn type 106 and the second yarn type 108 are integrally knit together. This is useful for textiles forming, for example, upper-body garments for females. The areas of a female upper-body garment, such as the chest portion, may be knit using both the first yarn type 106 and second yarn type 108, resulting in a more opaque knit textile that limits visibility through the garment in these areas.

Continuing, in other portions of the garment, where modesty is not a critical focus, the knit textile 100 may comprise only the second yarn type 108 (i.e. the second portions 104). The use of monofilament polyamide yarns in these areas causes the areas to be somewhat translucent/transparent due to the yarns themselves being translucent/transparent. Moreover, use of monofilament yarns in the second portions 104 promotes a high level of permeability. For example, the linear integrally knit structure 114 shown in in FIG. 1A exhibits air permeability as measured in cubic feet per minute (CFM) from about 1200 CFM to about 1400 CFM, from about 1250 CFM to about 1390 CFM, or from about 1290 CFM to about 1390 CFM, where air permeability is measured using ASTM D737 standards where a pressure differential of 125 Pascals is used.

In the second portion 104, the percentage by weight of the first yarn type 106 (e.g. PET) is generally 0%, resulting in the second portion 104 generally comprising only the second yarn type 108 (e.g. monofilament polyamide). The second yarn type 108 provides a high level of air permeability and transparency/translucency. It is advantageous to use monofilament yarns as the second yarn type 108 as these yarns exhibit better air permeability, while maintaining a lower snagging score since there are fewer filaments available for potential snagging. This may be beneficial as using yarns with high snagging scores would be inefficient and unfavorable for the wearer, especially during physical activity. The second portions 104 comprising the second yarn type 108 may be positioned in areas of a garment that need increased ventilation. For example, the second portions 104 may be positioned in areas of the garment corresponding to high heat and/or sweat producing areas of the human body when the garment is worn. Because the second portions 104 have a higher air permeability as compared to, for instance, the first portions 102, air from the external environment may more readily enter the garment to help cool the wearer (e.g., by evaporative heat transfer) and heat produced by the wearer may more readily escape the garment further helping to keep the wearer cool.

Figure 2A:
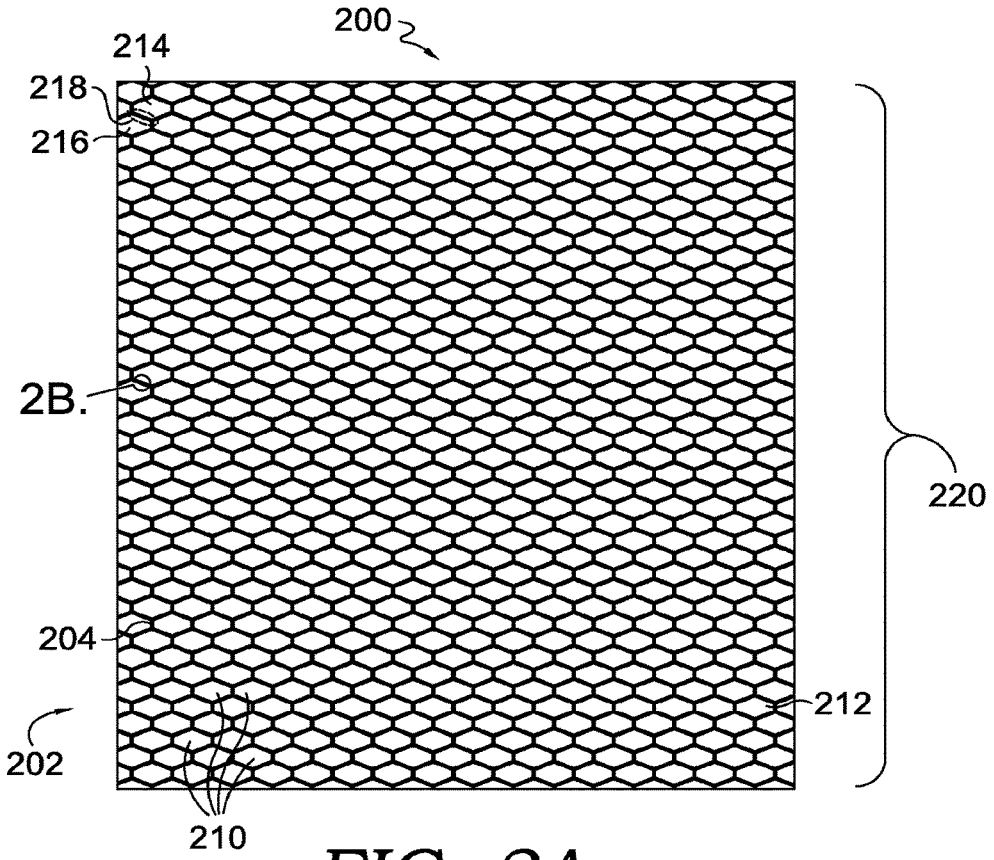
FIG. 2A depicts an alternate knit textile comprising a hexagonal knit structure in accordance with aspects herein.
Figure 2B:
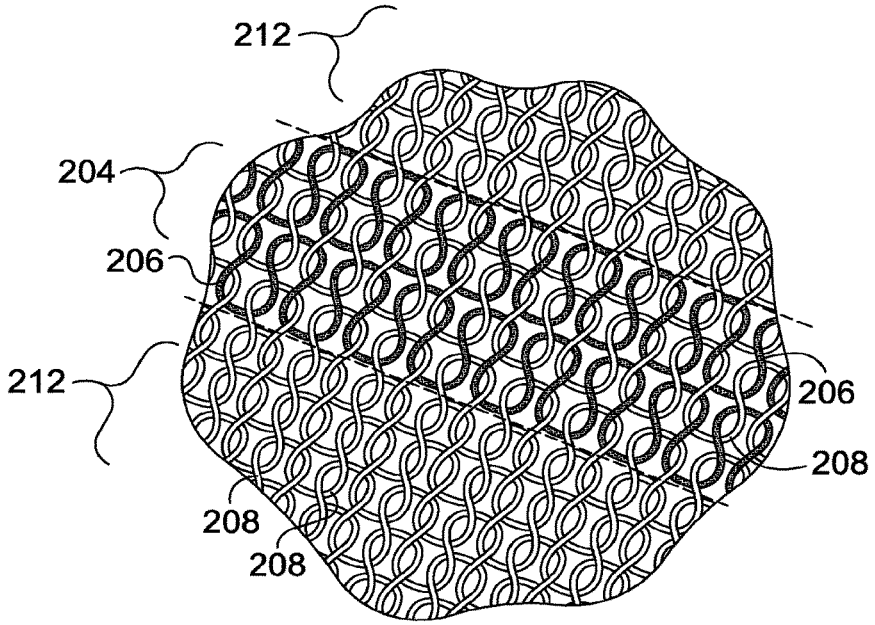
FIG. 2B depicts a close-up view of a portion of the knit textile depicted in FIG. 2A in accordance with aspects herein.

Moving onto FIGS. 2A and 2B, a two dimensional view of another knit textile 200 comprising a hexagonal knit structure 220 and a close-up view of the knit textile 200 respectively are illustrated in accordance with aspects herein. In this aspect, the knit textile 200 comprises a first surface 202 and a second surface (not shown) opposite the first surface 202. The first surface 202 of the knit textile 200 comprises a plurality of cells 210 (which may also be known as first portions), each cell 210 comprising a perimeter 204 that comprises a first percentage by weight of a first yarn type 206 (PET yarn). The perimeter 204 further comprises a second yarn type 208 (monofilament polyamide yarn) (best seen in FIG. 2B). Each cell 210 further comprises a central region 212 enclosed within the perimeter 204 (which may also be known as second portions).

Continuing, the plurality of perimeters 204 are interconnected throughout the knit textile 200 while the central regions 212 are isolated from one another throughout the knit textile 200. Each central region 212 comprises the second yarn type 208 and a second percentage by weight of the first yarn type 206. Similar to FIGS. 1A and 1B, the second percentage of weight of the first yarn type 206 is less than the first percentage of weight of the first yarn type 206. As shown in FIG. 2B, the second percentage of weight of the first yarn type 206 in the central region 212 is 0%. Therefore, in aspects, the first yarn type 206 does not extend into the central region 212. By contrast, the perimeters 204 surrounding the central regions 212, comprise both the first yarn type 206 and the second yarn type 208. The perimeter 204 and central region 212 are integrally knitted from each other. This knit construction may help to lock the second yarn type 208 in place and prevent shifting of the second yarn type 208 during wear. Each of the plurality of cells 210 share at least one common portion of the perimeter 204. For example, cells 214 and 216 share common portion 218. The second surface of the knit textile 200 may comprise a similar or different knit construction as the first surface 202.

It is contemplated that the shape of the plurality of cells 210 is generally ovoid or hexagonal. As shown in FIG. 2A, the knit textile 200 comprises a repeating pattern of hexagonal cells 210 that comprise the hexagonal knit structure 220. As shown in FIGS. 2A and 2B, each of the plurality of cells 210 is the same size and shape. In some aspects, the size of a first cell of the cells 210 may comprise a first size and a second cell of the cells 210 of may comprise a second size, wherein the second size is different from the first size. In other words, the knit textile 200 depicted in FIG. 2A may comprise a hexagonal knit structure 220 in which the plurality of hexagonal cells 210 comprise two or more different sizes. Further, the cells 210 may have different shapes, with a first cell of the cells 210 comprising a first shape and a second cell of the cells 210 comprising a second shape, the first shape being different than the second shape. For example, a first cell may comprise a hexagonal shape while a second cell may comprise another shape, such as a pentagon. In this example, the hexagonal shaped cells and the pentagon shaped cells would still be integrally knit from each other and may form any variation of repeating patterns comprising the knit structure of the knit textile 200. Further, the different cells would similarly have at least one common perimeter.

The hexagonal knit structure 220 of the knit textile 200 is advantageous as it provides good air permeability (by, for example, use of monofilament polyamide yarns), with measurements from about 900 CFM to about 1200 CFM, from about 950 CFM to about 1150 CFM, or from about 1000 CFM to about 1100 CFM as measured using ASTM D737 standards. Air permeability may differ slightly depending on the size of the individual cells 210 in the hexagonal knit structure 220. As seen in FIG. 2A, the interconnected structure of the perimeters 204 of the cells 210 may help create wicking channels that help moisture to disperse over the first surface 202 of the knit textile 200. To describe this differently, the presence of PET with its low moisture regain in the perimeters 204 of the cells, and the interconnected nature of the perimeters 204 may allow moisture to travel by capillary action between the PET filaments thereby dispersing the moisture over the first surface 202 of the knit textile 200.

Figure 4:
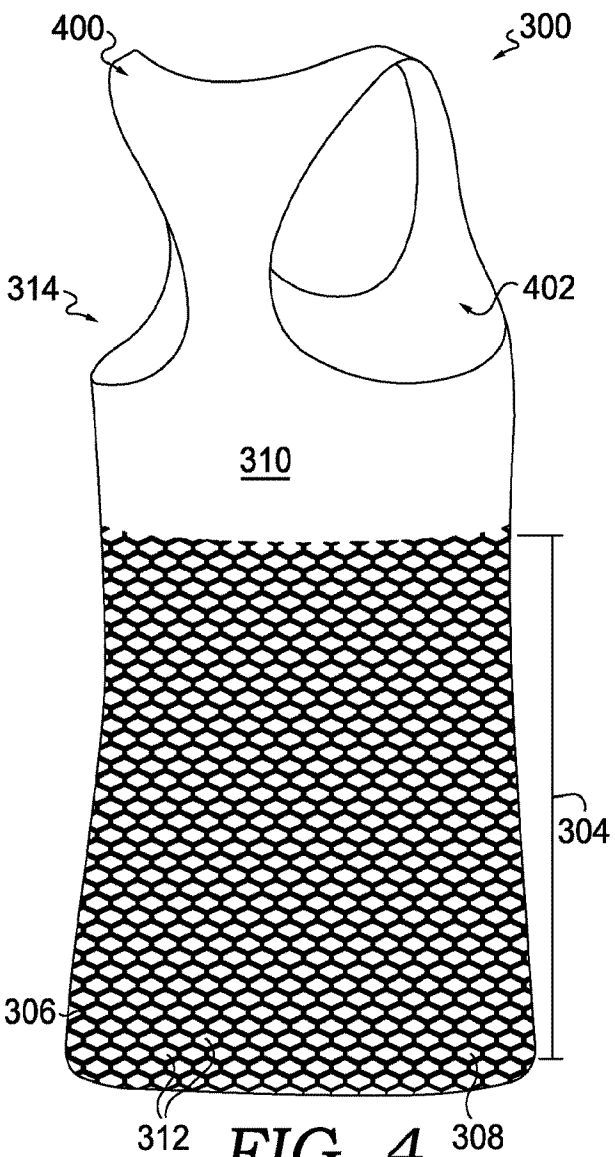
FIG. 4 depicts a back perspective view of the upper-body garment of FIG. 3 in accordance with aspects herein.
Figure 3:
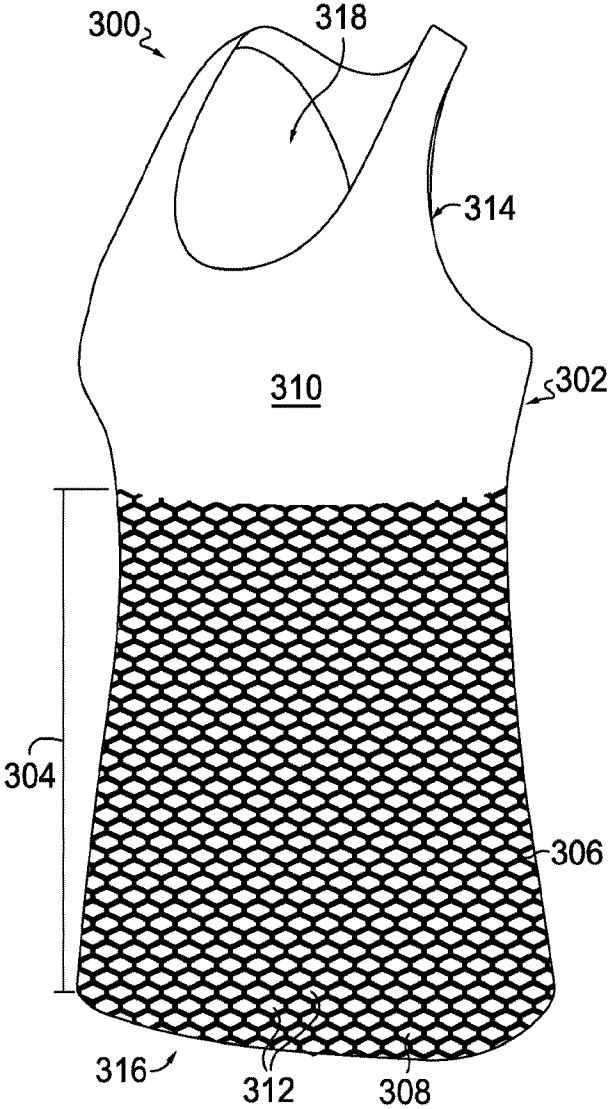
FIG. 3 depicts a front perspective view of an upper-body garment comprising at least the textile of FIG. 2A in accordance with aspects herein.

Turning next to FIGS. 3 and 4, a front perspective view and a back perspective view of an upper-body garment 300 comprising at least the knit textile 200 of FIG. 2A are illustrated in accordance with aspects herein. The upper-body garment 300 is shown in the form of an upper-body garment 300 (e.g. a sleeveless shirt), but it is contemplated herein that the upper-body garment 300 may be in the form of a lower-body garment, a whole body garment, and the like. Moreover, although shown in the form of a sleeveless shirt, the upper-body garment 300 may take other forms such as a jacket, pull-over, a hoodie, a vest, and the like. Any and all aspects, and any variation thereof are contemplated as being within aspects herein. In aspects, the upper-body garment 300 may be formed using a circular knitting process or a flat knitting process. In this aspect, the upper-body garment 300 may be shaped on the knitting machine such that when it comes off the knitting machine minimal post-processing works needs to be done. As a result, the upper-body garment 300 may comprise minimal to no seams (e.g., no side seams) which improves wearer comfort. Using the knitting process described herein also allows the upper-body garment 300 to be formed with different textile portions (linear knit structure, hexagonal knit structure, continuous knit structure) that integrally extend from one another.

As seen in FIG. 3, the upper-body garment 300 comprises arm openings 314, a neck opening 318, and waist opening 316. Additionally, the upper-body garment 300 has a first surface 302 and a second surface 402 opposite the first surface 302. In aspects, a hexagonal knit textile 304 similar to the knit textile 200 shown in FIGS. 2A and 2B may form a bottom portion of the upper-body garment 300. The hexagonal knit textile 304 comprises a plurality of cells 312. Each cell 312 comprises a plurality of perimeters that comprise a first percentage by weight of a first yarn type (not shown) and a second yarn type (not shown) similar to FIG. 2B. Each cell 312 further comprises a central region 308 enclosed within the perimeter 306. Each central region 308 comprises the second yarn type (not shown) and a second percentage by weight of the first yarn type (not shown). The plurality of perimeters 306 or first portions are interconnected while the central regions 308 or second portions are isolated from one another throughout the hexagonal knit textile 304. Additionally, as previously noted, the plurality of perimeters 306 and central regions 308 are integrally knit from one another. As seen in FIGS. 3-4, the plurality of perimeters 306 and the central regions 308 of the hexagonal knit textile 304 are shown as extending from the front to the back of the upper-body garment 300.

Further, the upper-body garment 300 further comprises at least one third portion 310 that is also integrally knit from the hexagonal knit textile 304. The third portion 310 comprises a continuous knit construction that comprises the second yarn type 208 and a third percentage by weight of the first yarn type 206. The third percentage by weight of the first yarn type 206 may be greater than the second percentage by weight of the first yarn type 206 found in the central region 308. The third portion 310 also extends from the front to the back of the upper-body garment 300.

As shown, the plurality of cells 312 comprising the hexagonal knit textile 304 seen in FIGS. 3 and 4 are generally the same size. However, as previously stated, it is contemplated that the knit structure comprising the hexagonal knit textile 304 may vary in size and shape. Regardless of the size or shape combination of the plurality of cells 312 comprising the hexagonal knit textile 304, the yarns comprising the hexagonal knit textile 304 will be integrally knit from one another.

In FIG. 3, due to the continuous knit structure of the third portion 310, the third portion 310 generally provides greater modesty than the hexagonal knit textile 304. In aspects, the third portion 310 may comprise a double-knit jersey construction although other knit constructions are contemplated herein. In this figure, the third portion 310 is a modesty segment provided for the female upper-body garment 300 to cover the chest and upper back areas when worn. While the third portion 310 is shown as being located in the chest and upper back region in FIGS. 3-4, similar modesty portions may be found in other locations in other aspects. For example, in another upper-body garment, the third portion 310 may be located on the sides of the upper-body garment so that these areas are not transparent/translucent when worn. Any and all aspects, and any variation thereof, are contemplated as being within aspects herein.

In this example, the upper-body garment 300 is sleeveless. However, it is contemplated that the upper-body garment 300 may include full sleeves, half sleeves, or any variation thereof. If the upper-body garment 300 includes sleeves, the construction of the sleeves may further comprise a knit construction similar to the third portion 310 or may comprise a knit construction similar to the hexagonal knit textile 304 comprising a plurality of cells 312. Any and all aspects, and any variation thereof are contemplated as being within aspects herein. Moreover, it is contemplated herein that the placement and position of the hexagonal knit textile 304 and the third portion 310 are examples only, and other variations are contemplated herein.

Figure 6:
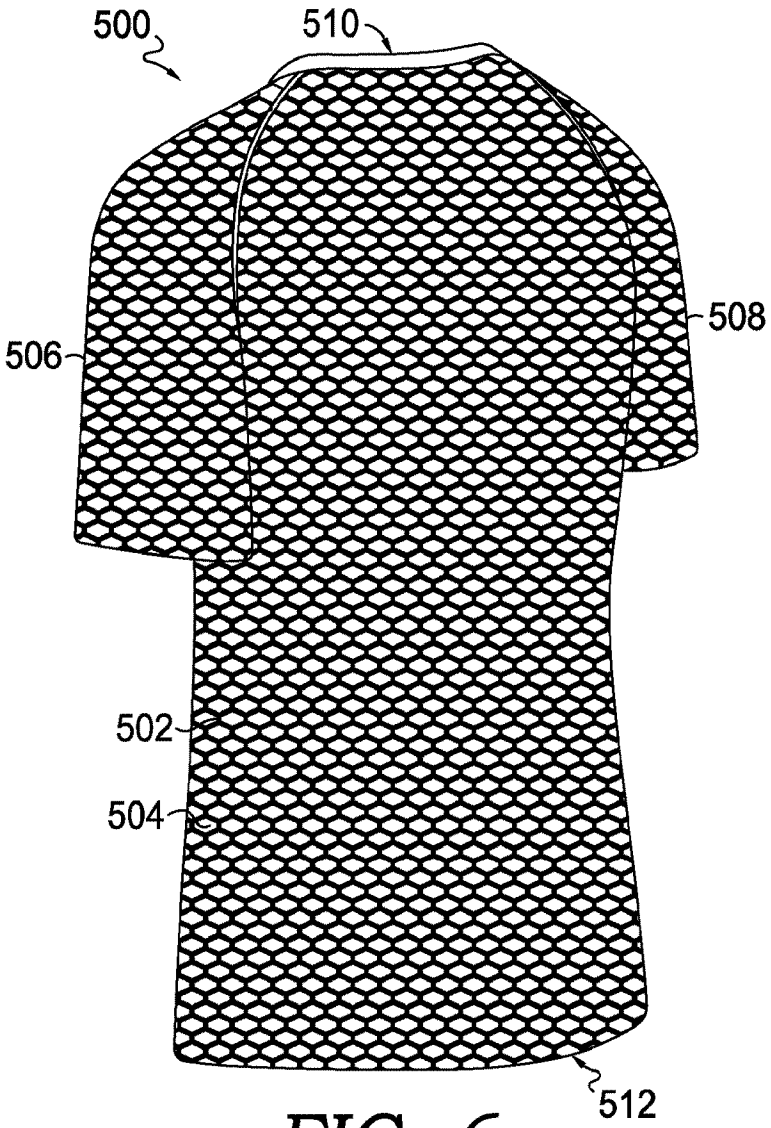
FIG. 6 depicts a back perspective view of the upper-body garment of FIG. 5 in accordance with aspects herein.
Figure 5:
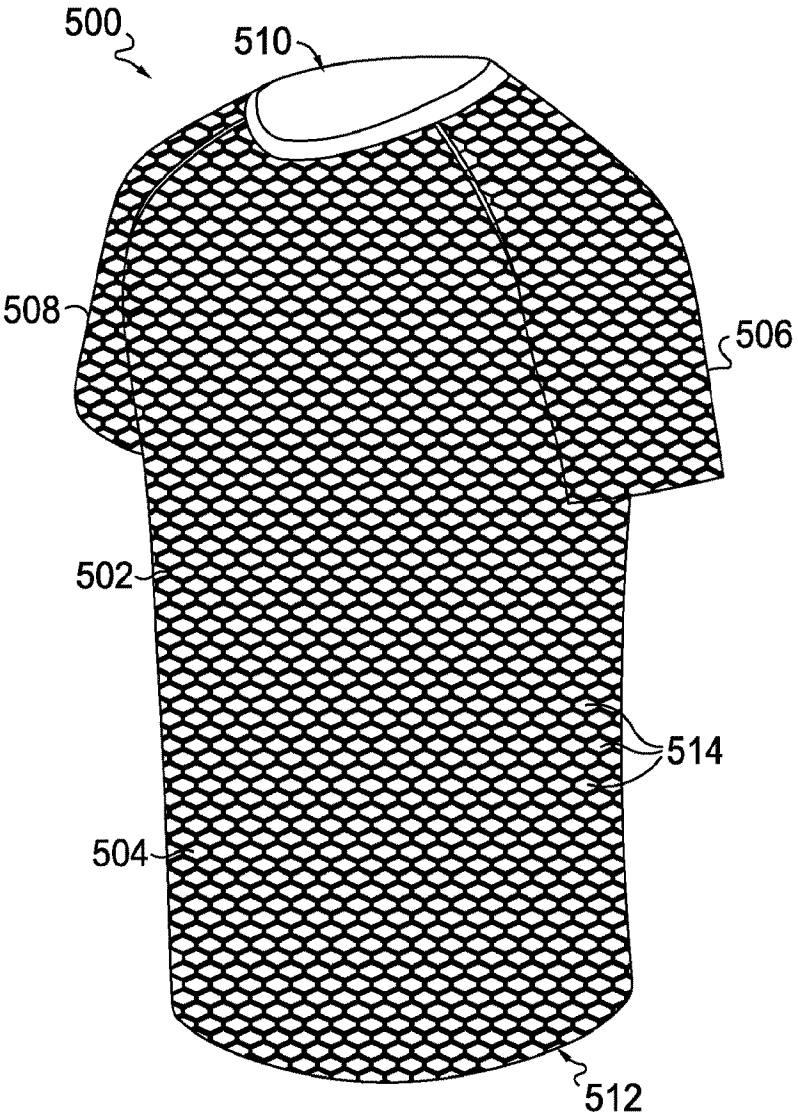
FIG. 5 depicts a front perspective view of an alternate upper-body garment comprising the textile of FIG. 2A in accordance with aspects herein.

FIGS. 5-6 depict front and back perspective views respectively of an alternate upper-body garment 500 in accordance with aspects herein. In this aspect, the upper-body garment 500 comprises a left short sleeve 506, right short sleeve 508, neck opening 510, and waist opening 512 when viewed in the as-worn configuration. While the upper-body garment 500 comprises short sleeves, it is contemplated that the upper-body garment 500 could include full sleeves, no sleeves, three-quarter sleeves, or any variation thereof.

Additionally, the integrally knit construction of the upper-body garment 500 comprises a knit construction similar to that shown in FIGS. 2A and 2B. That is, the upper-body garment 500 may comprise a plurality of cells 514 having a plurality of perimeters 502 and a plurality of central regions 504 that are continuous throughout the upper-body garment 500. The plurality of perimeters 502 may otherwise be known as a plurality of first portions and the plurality of central regions may otherwise be known as a plurality of second portions. In this aspect, no modesty panel is seen. As such, the upper-body garment 500 would appear generally transparent/translucent throughout and would provide permeability throughout the upper-body garment 500.

Figure 7:
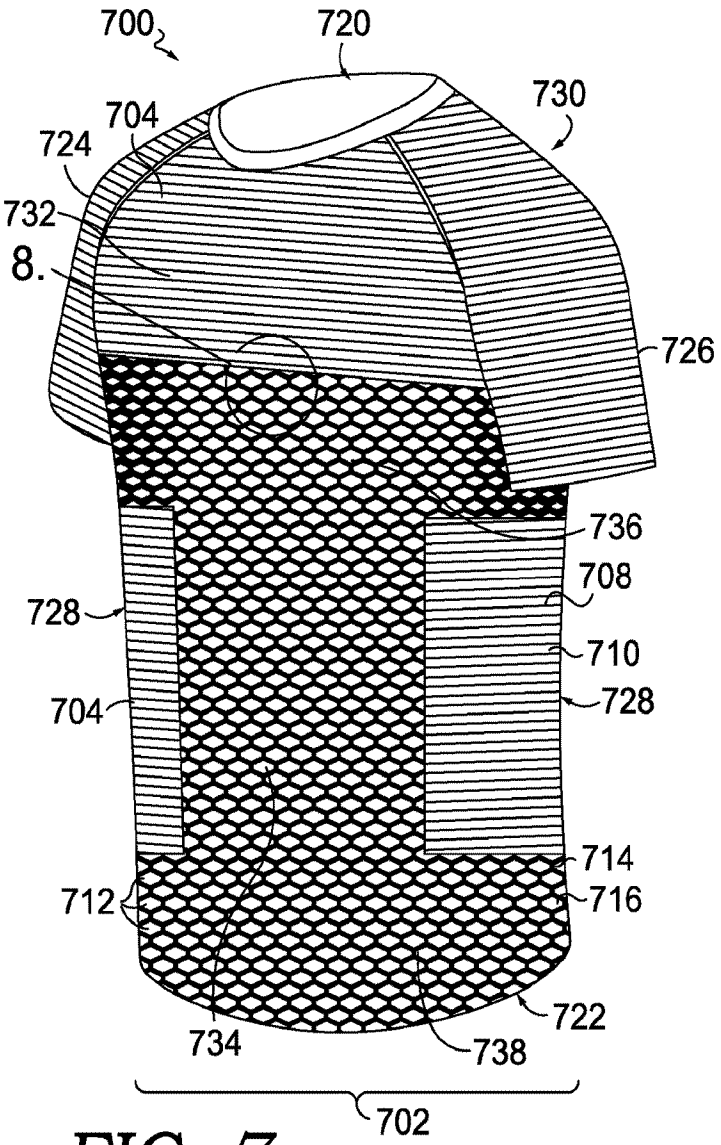
FIG. 7 depicts another upper-body garment comprising the knit textiles depicted in FIGS. 1A and 2A in accordance with aspects herein.

Next, FIG. 7 depicts another upper-body garment 700 comprising the knit textiles depicted in FIGS. 1A and 2A in accordance with aspects herein. In this aspect, the upper-body garment 700 comprises a neck opening 720, waist opening 722, a left short sleeve 726, and a right short sleeve 724 when viewed in the as-worn configuration. As shown, the upper-body garment 700 comprises both a linear knit textile 704 and a hexagonal knit textile 702, both of which have been previously described. The upper-body garment 700 shown comprises the first yarn type (PET) and the second yarn type (monofilament polyamide yarn) described herein, where the first and second yarn types are positioned as described for the knit textiles 100 and 200.

In FIG. 7, the linear knit textile 704 is positioned in the front upper chest 732, back upper chest (not shown), right short sleeve 724, left short sleeve 726, and side portions 728 of the upper-body garment 700. The linear knit textile 704 is integrally knit from the hexagonal knit textile 702 which is positioned on the front center 734, front mid-chest 736, front lower waist area 738, and corresponding portions of the back (not shown).

The location of the linear knit textile 704 and the hexagonal knit textile 702 may be based on, for instance, sweat and/or heat maps of the human body. In other words, because the linear knit textile 704 and the hexagonal knit textile 702 both exhibit high levels of air permeability as compared to, for instance, continuous knit constructions, they may be positioned where ventilation is needed most while balancing the need for modesty in certain areas, as seen in FIGS. 3-4. The disclosure provided for FIGS. 1A and 2A with respect to yarn types and percentages by weight of the yarn types is equally applicable to the linear knit textile 704 and the hexagonal knit textile 702.

Figure 8:
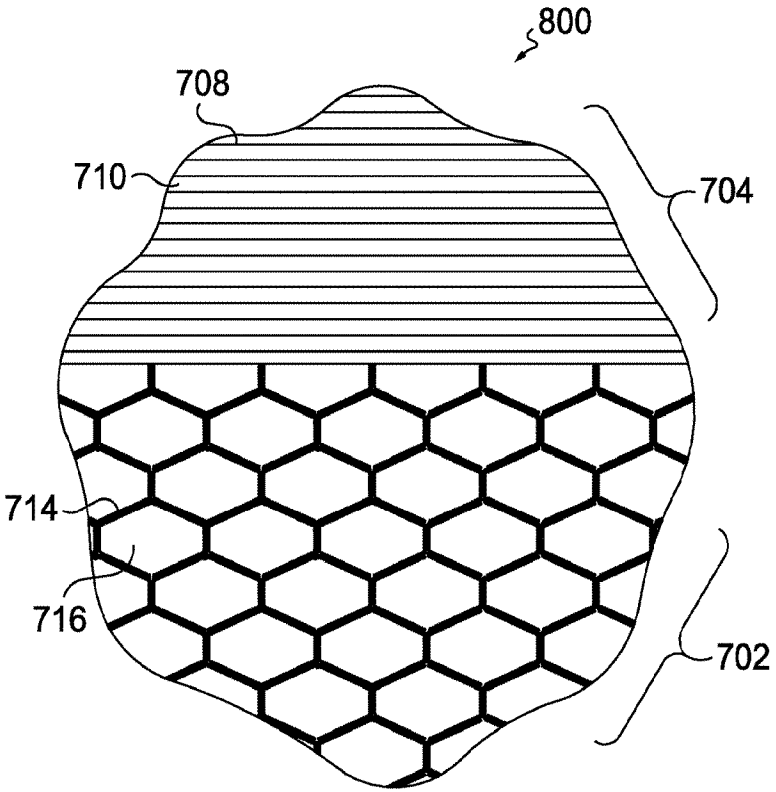
FIG. 8 is a close-up view of a portion of the upper-body garment of FIG. 7 in accordance with aspects herein.

FIG. 8 depicts a close-up view of a portion 800 of the upper-body garment 700. In the portion 800 shown, the linear knit textile 704 integrally extends from the hexagonal knit textile 702. The placement of the linear knit textile 704 and the hexagonal knit textile 702 in FIG. 8 is one example of a potential construction of the upper-body garment 700 and other variations of placement of the linear knit textile 704 and hexagonal knit textile 702 are contemplated herein.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different products may be made of the knitted textiles herein, without departing from the scope thereof, it is to be understood that all matter herein set forth or shown in the accompanying drawings is to be interpreted as illustrative and not in a limiting sense.

Having thus described the invention, what is claimed is:

1. An apparel item comprising:

a first knit textile comprising a cell configuration having a single knit construction and comprising at least a first surface and a second surface opposite the first surface, wherein:

the cell configuration comprises a knitted perimeter portion and a knitted central portion that is integrally knitted with, and enclosed within, the knitted perimeter portion, the knitted perimeter portion comprises a first percentage by weight of a first yarn type and comprises a second yam type, the first yarn type and the second yarn type form the first surface and the second surface of the knitted perimeter portion, and the knitted central portion comprises solely the second yarn type, wherein the second yarn type forms the first surface and the second surface of the central region of the knit textile; and a second knit textile integrally knit with the first knit textile and comprising a plurality of linear knit portions, wherein:

a first linear knit portion of the plurality of linear knit portions is directly interlooped with a second linear knit portion;

the first linear knit portion comprises a first percentage by weight of the first yarn type and comprises the second yarn type; and the second linear knit portion comprises solely the second yam type.

2. The apparel item of claim 1, wherein a moisture regain of the first yarn type is less than the moisture regain of the second yam type.

3. The apparel item of claim 1, wherein the first yarn type comprises a terephthalate polymer.

4. The apparel item of claim 3, wherein the terephthalate polymer comprises a polyethylene terephthalate (PET) comprising a cationic dyeable PET.

5. The apparel item of claim 1, wherein the second yarn type is a monofilament comprising a polyimide.

6. The apparel item of claim 1, wherein the second yarn type has a denier from about 23 denier to about 43 denier and the first yam type has a denier from about 30 denier to about 100 denier.

7. The apparel item of claim 1, wherein a shape of the cell configuration is generally ovoid.

8. The apparel item of claim 1, wherein at least a portion of the second yarn type is transparent or translucent.

9. An integrally knit textile having a single knit construction, the textile comprising:

a first knit textile comprising a plurality of cells, each cell comprising a first surface and a second surface opposite the first surface and comprising:

a perimeter comprising a first percentage by weight of a first yam type, the perimeter further comprising a second yarn type, wherein the perimeter of each cell of the plurality of cells is interconnected throughout the first knit textile and wherein the first yarn type and the second yarn type form the first surface and the second surface of the perimeter; and a central region enclosed within the perimeter, the central region comprising solely the second yarn type, wherein the central region of each cell of the plurality of cells is isolated from one another and wherein the second yarn type forms the first surface and the second surface of the second portion of the textile; and a second linear knit textile comprising:

a plurality of first portions comprising the first percentage by weight of the first yarn type and comprising the second yam type; and a plurality of second portions that are interlooped with the plurality of first portions and that comprise solely the second yarn type.

10. The integrally knit textile of claim 9, wherein air permeability of the integrally knit textile is from about 1000 cubic feet per meter (CFM) to about 1400 CFM.

11. The integrally knit textile of claim 9, wherein a first cell and a second cell in the plurality of cells have at least one common portion of the perimeter.

12. The integrally knit textile of claim 9, wherein the plurality of first portions and the plurality of second portions of the second linear knit textile have the same width.

13. An article of apparel comprising:

a first knit textile comprising a cell configuration, wherein:

the cell configuration comprises a knitted perimeter portion having a first surface and a second surface opposite the first surface and a knitted central portion having a first surface and a second surface opposite the first surface that is integrally knitted with, and enclosed within the knitted perimeter portion;

the knitted perimeter portion comprises a first percentage by weight of a first yarn type and comprises a second yam type, wherein the first yarn type and the second yarn type form the first surface and the second surface of the knitted perimeter portion of the first knit textile; and the knitted central portion comprises solely the second yam type, wherein the second yarn type forms the first surface and the second surface of the knitted central portion of the first knit textile; and a second knit textile integrally knit with the first knit textile and comprising a plurality of linear knit portions, wherein:

a first linear knit portion of the plurality of linear knit portions is directly interlooped with a second linear knit portion;

the first linear knit portion comprises a first percentage by weight of the first yarn type and comprises the second yarn type;

the second linear knit portion comprises a second percentage by weight of the first yarn type; and the second percentage by weight of the first yarn type is less than the first percentage by weight of the first yarn type.

14. The article of apparel of claim 13, wherein the first yarn type comprises a terephthalate polymer.

15. The article of apparel of claim 14, wherein the terephthalate polymer comprises a polyethylene terephthalate (PET) comprising a cationic dyeable PET.

16. The article of apparel of claim 13, wherein the second yam type is a monofilament comprising a polyimide.

17. The article of apparel of claim 13, wherein the second percentage by weight of the first yarn type is less than 20%.

* * * * *